US005401326A

United States Patent [19]

Mihelic et al.

[11] Patent Number: 5,401,326

[45] Date of Patent: Mar. 28, 1995

[54] MICROEMULSION CLEANSERS AND THEIR USES

[75] Inventors: Joseph Mihelic, Sparta; Lionel B. Luttinger, Andover, both of N.J.

[73] Assignee: Drew Chemical Corporation, Boonton, N.J.

[21] Appl. No.: 99,209

[22] Filed: Jul. 29, 1993

[51] Int. Cl.[6] ..... B08B 3/08; C23G 5/036; C11D 1/83; C11D 3/16

[52] U.S. Cl. ..... 134/40; 134/38; 134/39; 252/153; 252/172; 252/174; 252/174.21; 252/DIG. 1; 252/559; 252/174.15; 252/173; 252/162

[58] Field of Search ..... 252/153, 172, 174, 174.21, 252/392, 403, 405, DIG. 1, 559, 174.15, 173, 162; 134/38, 39, 40

[56] References Cited

U.S. PATENT DOCUMENTS

| | | | |
|---|---|---|---|
| 2,418,909 | 4/1947 | Skinner | 134/39 |
| 4,146,499 | 3/1979 | Rosano | 252/186 |
| 4,689,168 | 8/1987 | Requejo | 252/139 |
| 5,100,571 | 3/1992 | Hartman | 252/75 |
| 5,112,516 | 5/1992 | Koetzle | 252/162 |

*Primary Examiner*—Paul Lieberman
*Assistant Examiner*—Douglas J. McGinty
*Attorney, Agent, or Firm*—David L. Hedden

[57] ABSTRACT

This invention relates to microemulsion cleaners comprising (a) an organic solvent (b) a surfactant blend comprising an anionic and nonionic surfactant (c) a glycol ether (d) morpholine, and (e) water. These cleaners can be used for removing baked-on oil and carbon deposits.

23 Claims, No Drawings

MICROEMULSION CLEANSERS AND THEIR USES

FIELD OF THE INVENTION

This invention relates to microemulsion cleaners comprising (a) an organic solvent (b) a surfactant blend comprising an anionic surfactant and a nonionic surfactant (c) a glycol ether (d) morpholine, and (e) water. These cleaners can be used for removing oil, grease, and baked-on carbon deposits from metal surfaces.

BACKGROUND

The importance of industrial and marine cleaners which clean metal parts effectively is clearly recognized. Although such cleaners are available in the marketplace, there is a need for improved cleaners which can be easily handled and used. Typically the cleaners used for such applications are either solutions or macroemulsion cleaners. However, there are disadvantages in using such products.

One of the major disadvantages of these macroemulsion cleaners is that they are not convenient to use since they must be prepared as a water emulsion just prior to use due to the instability of the macroemulsion. Water emulsions are cumbersome to use and a significant source of cleaning failures, especially under shipboard conditions, because they break into two phases. Furthermore, mixing can result in inconsistent results due to variations in the concentration of components of the macroemulsion as prepared.

Another major disadvantage of such cleaners is that they are milky emulsions which leave milky residues on cleaned equipment and require a further water rinse which is undesirable.

Additionally, solution cleaners based upon solvents, and even many macroemulsion cleaners often have low flash points which can be unsafe when the cleaners are used for cleaning hot equipment, particularly air coolers on diesel engine trains. The air cooler of a diesel train is conventionally cleaned using such a freshly prepared macroemulsion in water. The water is added to eliminate the flash point, which would otherwise create a potential hazard on the hot equipment.

Even so, due to the vagaries in macroemulsion preparation on shipboard just prior to use, a potentially hazardous flashpoint may occur. Usually these macroemulsion cleaners are stable for only a few hours. Consequently, if the personnel involved in the cleaning are suddenly needed elsewhere during the course of the air cooler cleaning treatment or do not carry out the macroemulsification properly, the emulsion and water could separate with the result that the emulsion would again have a low flashpoint. This could result in a hazard and also in reduced cleaning effectiveness.

In addition to these major disadvantages, there are several other deficiencies macroemulsion cleaners have when used to clean industrial and marine equipment:

(a) The cleaners do not drain effectively which results in excessive post rinsing.

(b) The cleaners generate foam during the cleaning process.

(c) Cleaning effectiveness is sometimes inadequate.

(d) These cleaners are available only as a concentrate. The use of such concentrates requires on-site mixing.

The other major class of cleaners consist of detergents in solutions of water or solvents which also have limitations. Water-based formulations are ineffective on oil and soils. Solvent-based detergents possess flash points which render them hazardous when applied to thermally or electrically "live" equipment.

SUMMARY

This invention relates to microemulsion cleaners comprising:

(a) an organic solvent;

(b) an anionic/nonionic surfactant blend;

(c) a glycol ether;

(d) morpholine; and (e) water.

These microemulsion cleaners show many advantages when compared to the macroemulsion cleaners currently used for industrial and marine cleaning. They can be formulated as concentrates, or as ready-to-use products by further dilution with water when manufactured. The ready-to-use cleaners do not have to be prepared at the application site, as do the more conventional unstable macroemulsions. The cleaners do not foam and are stable at temperatures up to 74° C. for at least several months.

The cleaners are all purpose cleaners, and are highly effective for cleaning metals and air coolers. They effectively remove baked-on oil, carbon, and engine varnish deposits from metal surfaces, particularly steel. The cleaners are easy to handle, mildly alkaline and have a clear to slightly hazy appearance. Although the cleaners incorporate organic solvents and volatile corrosion inhibitors, they are safe to use because they do not have flash points up to 104° C. or their boiling points.

These cleaners are used in spray and soak cleaning. They are free draining and no heavy water rinse of cleaned equipment is required since these cleaners do not leave a milky residue.

ENABLING DISCLOSURE AND BEST MODE

Various organic solvents can be used in the microemulsion cleaners, such a aromatic and aliphatic organic solvents. These organic solvents are flammable or combustible organic solvents, yet, in the subject cleaners, their flash points are eliminated by the addition of morpholine and water.

Examples of suitable organic solvents are dichlorotoluene, monochlorotoluene, ortho dichlorobenzene, methyl naphthalene, alkyl esters such as Exxon EXXATE® 900 solvent (a $C_9$ alkyl acetate), m-pyrol sold by GAF and BASF, and terpenes such as GLIDSOL® 180 sold by SCM and GLIDCO. Preferred solvents are Exxon aromatic solvents 200 and 200 ND (largely methyl naphthalene) and dichlorotoluene sold by Oxy Chemical, and Exxon EXXATE 900.

The amount of organic solvent used in the ready-to-use cleaner is from 5 to 40 weight percent, typically from 5–25 weight percent, preferably from 7–18 weight percent, and most preferably 10–12 weight percent, where said weight percent is based upon the total weight of the microemulsion cleaner. In the concentrate, typically from 10–30 weight percent, preferably 18 to 25 weight percent, where said weight percent is based upon the total weight of the microemulsion cleaner.

Surfactant blends comprising an anionic surfactant and a nonionic surfactant are used in the microemulsion cleaners in weight ratios of 20:1 to 1:20, preferably 10:1 to 1:10, most preferably 4:1 to 1:4 based upon the total weight of the surfactants in the blend. The total amount of surfactant in the microemulsion cleaner is from 5 to 35 weight percent, preferably 10 to 25 weight percent, most preferably 12 to 18 weight percent.

These figures refer to the "ready to use" microemulsions. The concentrate preferably contains 7 to 50 weight percent, typically 10 to 40 weight percent, preferably 15–25 weight percent total surfactants.

The anionic surfactants used are typically sulfonates, sulfates, or alkyl sulfonates such as dodecyl benzene sulfo succinate salts having an average molecular weight of about 300 to about 3000. Examples of anionic surfactants which can be used in the microemulsion cleaner include diisooctyl sulfo succinate (AERSOL® OT from American Cyanamid), NAXEL® AAS-40 S and 45 S anionic surfactants (from Rutgers Nease or from CONOCO). The NAXEL surfactants are 40 percent solutions of sodium dodecyl benzene sulfonate in water.

The nonionic surfactants used are most typically reaction products of long-chain alcohols with several moles of ethylene oxide having an average molecular weight of about 300 to about 3000. Nonionic surfactants which can be used in the microemulsion cleaners preferably are blends of linear alcohol ethoxylates such as those containing $C_9$–$C_{11}$ and $C_{12}$–$C_{18}$ carbon atoms in the linear alcohol chain ethoxylated with an average of 2.5 and/or 6.0 moles of ethylene oxide per chain. Preferably used are mixtures of $C_9$–$C_{11}$ linear alcohols ethoxylated with an average of 2.5 and 6.0 moles of ethylene oxide per chain. The ratio of the 6 mole ethoxylates to 2.5 moles ethoxylates in the blend is preferably in the range of 1.5:1 to 2:1.

A good example of effective linear ethoxylated alcohol surfactants are Shell NEODOL® 91-2.5 and 91-6 surfactants which are shown in Table II.

For the "ready-to-use" formulations, generally at least 5 to 40 weight percent, preferably at least 10 to 25 weight percent, of the nonionic surfactant is required, said weight percent being based upon the weight of the microemulsion cleaner. Higher amounts can be used, but are less cost effective. For the microemulsion cleaner concentrates, generally from 5 to 40 weight percent of the nonionic is used, preferably 15 to 25 weight percent, assuming the presence of 10 weight percent water.

For the microemulsion cleaner, the concentration of the active amount of anionic surfactant (active) is generally about from 1.5 to 5.0 weight percent active based upon the weight of the microemulsion cleaner, preferably about 1.5 to about 3.0 weight percent, most preferably about 2.0 weight percent. For the concentrate, the concentration of the anionic surfactant (active) is generally about from 1.5 to 5.0 weight percent active based upon the weight of the microemulsion cleaner concentrate, preferably about 2.0 to about 4.0 weight percent, most preferably about 3.5 weight percent. Generally, these anionic surfactants are sold as solutions in water. For instance, the NAXEL® surfactants are 40 percent solutions of anionic surfactant in water. Thus the amount of NAXCEL surfactant as a solution used is about 8.5 weight percent based upon the weight of the microemulsion cleaner.

Glycol ethers which can be used in the microemulsion cleaners include such as dipropylene glycol monomethylether (DPM) or tripropylene glycol monomethylether (TPM). Preferably used as the glycol ether is DPM. If DPM is used, the amount of glycol ether used in the microemulsion cleaner is from 5 to 40 weight percent, preferably 10 to 25 weight percent, most preferably 18 to 22 weight percent, said weight percent is based upon the total weight of the microemulsion cleaner. For the concentrate, the quantity of DPM is preferably from 15–40 weight percent, most preferably 25–35 weight percent.

If TPM is used, the amounts used are optimally about 15 percent greater than if DPM is used.

The microemulsion cleaners also contains morpholine in an amount of from 4 to 40 weight percent, preferably 5 to 10 weight percent based upon the total weight of the microemulsion cleaner. Although more than 10 weight percent of morpholine can be used, amounts more than 10 weight percent are not cost effective, most primarily 10 to 15 weight percent and above.

In addition to flashpoint inhibition, the morpholine acts as a vapor phase, contact phase, and interphase corrosion inhibitor in the cleaner equipment by inhibiting flash rusting which is often observed after conventional cleaning.

Morpholine also acts as a corrosion inhibitor in the microemulsion cleaner, due to the pH of the cleaner, for copper and aluminum as well as for steel. All three metals may be present in the equipment to be cleaned with the microemulsion cleaners.

The microemulsion cleaners also contain water. The amount of water in the cleaner depends upon whether one is formulating a concentrate or a ready-to-use cleaner. The amount of water the concentrate is from 3 to 25 weight percent, preferably 5 to 15 weight percent, most preferably 7 to 14 weight percent, said weight percent is based upon the total weight of the microemulsion cleaner concentrate.

The amount of water used in the ready-to-use cleaner is from 25 to 60 weight percent, preferably 35 to 60, most preferably 45 to 55, said weight percent is based upon the total weight of the microemulsion cleaner.

The microemulsion may also contain a defoamer. A wide variety of defoamers can be used in the microemulsion cleaner. Typically used as defoamers are polydimethyl siloxane type compounds. A specific example is DREWPLUS® L-8905 defoamer. The amount of defoamer used in the microemulsion cleaner is from 0.001 to 0.5 weight percent, preferably 0.02 to 0.2 weight percent, most preferably 0.05 to 0.1 weight percent, said weight percent is based upon the total weight of the microemulsion cleaner.

Preferably, the microemulsion ready-to-use cleaners comprise:

(a) from about 10 to 12 weight percent of an organic solvent such as aromatic or aliphatic hydrocarbon solvent, dichlorotoluene, terpene hydrocarbon, or oxyalcohol esters, or M-pyrol;

(b) from about 12 to 18 weight percent of a surfactant blend comprising anionic and nonionic surfactants wherein the weight ratio of anionic surfactant to nonionic surfactant is from 1:4 to 4:1 with the nonionic surfactant being at least 8 to 10 weight percent of the microemulsion cleaner;

(c) from about 18 to 22 weight percent of DPM;

(d) from 5 to 10 weight percent of morpholine;

(e) from 0.001 to 0.1 weight percent of a defoamer; and (f) from 35 weight percent water for the concentrate and up to 60 percent by weight of water for the ready-to-use microemulsion cleaner.

All weight percents are based upon the total weight of the microemulsion cleaner.

One of the surprising aspects of this invention is that the microemulsion cleaners do not have flash points (they instead cause a flame to be extinguished) even though the components of the macroemulsions do, i.e. typical organic solvents have flash point in the range 10° C. to 100° C.; morpholine has a flash point of 37° C. to 38° C.; and glycol ethers such as DPM has a flash point of 74° C.

The microemulsion concentrates described here can be used in a variety of other cleaning applications, such as storage tanks, pipes, and internal parts of pumps used to transfer liquid which require cleaning with cleaning products that have no flash point. They can also be used as an "engine shampoo" cleaner. In this application, the defoamer is left out since foaming is desirable in this type of cleaner.

It is believed that the enhanced cleaning effect of the microemulsion cleaners may relate to the presence of ultra-fine droplets, either water-in-oil and/or oil-in water, having diameters of 0.001 micron to 0.01 micron, which are stable in the microemulsion cleaner. The transparency and clarity of the microemulsion cleaner are evidence of this stability.

ABBREVIATIONS

The following abbreviations are used in the Examples:

ACC-9=A macroemulsion cleaner sold by Drew Marine Division of Ashland Chemical, Inc. The formulation is described in Table I as the Control (CNT).

DCT Technical=a mixture of isomers of dichlorotoluene

Fuel Oil #2=a mixture of aliphatic and aromatic hydrocarbons sold as heating fuel Fuel Oil #6=a heavy oil, highly viscous, used as a fuel in low speed diesel engines, etc.

MPD-13-117=a nonionic surfactant which is the reaction product of coco fatty acid and diethanol amine, sold by Mona, Heterene, etc.

Aromatic 200ND=a mixture mainly of methyl naphthalenes sold by Exxon

Aromatic 200=similar to Aromatic 200ND except it contains up to about 10 weight percent of naphthalene Dowanol DPM =dipropylene glycol mono methyl ether sold by Dow Chemical Company Naxel AAS-45S=a solution of 40 weight percent sodium dodecyl benzene sulfonate in water Neodol 91-2.5=a nonionic surfactant which is the reaction product of $C_9$–$C_{11}$ linear alcohols with ethoxylates averaging 2.5 ethylene oxide units per molecule sold by Shell Oil Company Neodol 91-6=a nonionic surfactant which is the reaction product of $C_9$–$C_{11}$ linear alcohols with ethoxylates, averaging 6 ethylene oxide units per molecule sold by Shell Oil Company Drewplus L-8905=a defoamer based upon dimethylsiloxane sold by Drew Industrial Dowanol TPM=tripropylene glycol mono methyl ether sold by Dow Chemical Company GLIDSOL 180=a terpene blend sold by SCM/GLIDCO

EXAMPLES

The examples will describe the "ready-to-use" microemulsion cleaners and concentrates. The Spray and Soak Evaluation and the Static Soak Evaluation test procedures used to evaluate the microemulsion cleaners are described as follows:

SPRAY TANK EVALUATION PROCEDURE (STEP)

(Test for removal of fuel oil #6 deposits.)

1. Apply cleaning spray pressure (30 psi) using adjustable spray pattern nozzle.
2. Clean for 10 minutes (spray the cleaner over fuel oil #6 deposit). Cleaning is performed at room temperature (25° C.).
3. Spray nozzle is positioned in the middle of the tank reservoir. Spray pattern is adjusted to cover the oil-coated steel coupon (coupon size: 10 cm×5 cm).
4. The optimum weight of fuel oil #6 applied to the coupon surface is in the range of 2.5–3.0 grams.
5. Each formulation is run in triplicate and the results are averaged.
6. Cleaning performance is measured as follows:

$$\frac{A-B}{A} \times 100 = \%\text{ oil deposit removed}$$

where A is the initial weight of fuel oil #6 deposit and B is the final weight of fuel oil #6 deposit.

Cleaning conditions were adopted to produce 60% to 80% fuel oil #6 removal at room temperature, using ACC-9 macroemulsion containing 67% weight percent water. In this "STEP" test, the oil was typically applied to the coupon at room temperature.

STATIC SOAK EVALUATION TEST (SSET) FOR CLEANING FUEL OIL #6 DEPOSITS

The test procedure for static soak evaluation testing is as follows:

1. Stainless steel coupons (size 7.5×1.30 cm) are coated with fuel oil #6 and the weight of the oil on the coupon is measured.
2. Four ounce jars containing candidate cleaners are prepared. Tap water is used as a "blank".
3. The oil coated coupons are placed in 4 oz jars. The jars are placed on a counter without shaking. The cleaning is performed at room temperature (25° C.).
4. One set of coupons is removed from the cleaning solutions after 3 hours and the other set after 6 hours of cleaning. The coupons are then allowed to dry to a constant weight and the final weight is measured.
5. Based on weight loss of fuel oil #6, cleaning performance of the cleaners was calculated:

$$\frac{A-B}{A} \times 100 = \%\text{ oil deposit removed}$$

where A is the initial weight of the fuel oil #6 and B is the final weight of fuel oil #6.

In this "SSET" test, the #6 oil was first baked-on the coupon by heating to 60° C. for 30 minutes.

CONTROL

Table I gives the formulation of a commercially available water macroemulsion cleaner as tested on baked-on fuel oil #6 deposits. The macroemulsion cleaner is prepared by blending 33% ACC-9 and 67% water. The macroemulsion is stable for 2–4 hours, but must be mixed just prior to use.

TABIE I

FORMULATION OF ACC-9 (CONTROL) (macroemulsion cleaner)

| Component | Amount |
|---|---|
| DCT Technical | 60.0 |
| Fuel Oil #2 | 32.5 |
| MPD 13-117 | 7.5 |
| Dyes | 0.001 |

The flashpoint of this macroemulsion cleaner is about 77° C. The cleaning test results are given in Table III, column "C" (CONTROL).

Table II gives the formulations of several microemulsion cleaners within the scope of this invention while Table III shows the cleaning efficacy of these cleaners.

TABLE II

| | EXAMPLE NUMBER | | | | | |
|---|---|---|---|---|---|---|
| COMPONENT | 1 | 2 | 3 | 4 | 5 | 6 |
| Aromatic 200ND | 7.5 | — | 10.5 | — | — | — |
| Aromatic 200 | — | — | — | — | 7.5 | 10.5 |
| DCT Technical | — | 7.5 | — | 10.5 | — | — |
| Morpholine | 7.5 | 7.5 | 7.5 | 7.5 | 7.5 | 7.5 |
| Dowanol DPM | 20.0 | 20.0 | 20.0 | 20.0 | 20.0 | 20.0 |
| Naxel AAS-45S | 5.0 | 5.0 | 5.0 | 5.0 | 5.0 | 5.0 |
| Neodol 91-6 | 5.0 | 5.0 | 6.0 | 6.0 | 6.0 | 6.0 |
| Neodol 91-2.5 | 3.0 | 3.0 | 4.0 | 4.0 | 3.0 | 4.0 |
| Water (regular tap) | 51.9 | 51.9 | 46.9 | 46.9 | 51.9 | 46.9 |
| Drewplus L-8905 | 0.1 | 0.1 | 0.1 | 0.1 | 0.1 | 0.05 |

There was no flashpoint as determined by the Pensky-Martin test for the microemulsion cleaners of Examples 1–6.

The cleaner of Example 6 is an optimum microemulsion cleaner for the removal of baked-on Fuel Oil #6 deposits (soak and spray cleaning) compared to the Control (ACC-9) macroemulsion cleaner of Table I.

The cleaners of Examples 3 and 4 are also optimum formulations that contain an optimum concentration (10.5%) of hydrocarbon or chlorinated hydrocarbon solvents.

The cleaners of Examples 1 and 2 of Table II show reduced cleaning performance when the hydrocarbon or chlorinated hydrocarbon solvent concentration is reduced from 10.5 percent to 7.5 percent (compare to the cleaners od Examples 3, 4, and 6 of Table III). In Table III, the superiority of the cleaners of Examples 3, 4, and 6 is shown by the data obtained in the "Soak Tests" after only 3 hours.

After 6 hours, all the cleaners in these Tables removed almost all the baked-on oil. The fact that better results were obtained for the cleaners of Examples 3, 4, and 6 after only three hours shows these formulations are the most effective cleaners.

Again, in the "Spray Cleaning Tests" in the upper part of the Table III, the cleaners of Examples 3, 4, and 6 give the best results.

Table III also gives the test results for the Control (the macroemulsion cleaner known as ACC-9) and the cleaners of Examples 1–6 set forth in Table II. The results show that the cleaners of Examples 1–6 are more effective than the CONTROL (C). In fact, based on the Spray Test results, all six microemulsion cleaners are superior to the Control.

TABLE III

| | EXAMPLE NUMBER | | | | | | |
|---|---|---|---|---|---|---|---|
| COMPONENT | C | 1 | 2 | 3 | 4 | 5 | 6 |
| Flashpoint (PMCC) | none to boil in Examples 1–6 | | | | | | |
| % Oil #6 Removed - Spray Tank Cleaning Method | 74.0 | 82.2 | 85.4 | 90.7 | 90.9 | 82.0 | 92.3 |
| % Oil #6 Removed - Soak Method after three hours soak | 69.1 | 66.0 | 65.6 | 97.0 | 95.4 | 66.1 | 97.7 |

TABIE IV

| Component (wt. %) | EX. 7 | EX. 8 (Concentrate) |
|---|---|---|
| Aromatic 200 | 5.25 | 8.91 |
| Exxate 900 | 5.25 | 8.91 |
| Morpholine 99% | 7.5 | 12.69 |
| Dowanol DPM | 20.0 | 33.93 |
| Naxel AAS-45S | 5.0 | 8.46 |
| Neodol 91-6 | 6.0 | 10.26 |
| Neodol 91-2.5 | 4.0 | 6.75 |
| Water Regular Tap | 46.95 | 10.00 |
| Drewplus L-8905 | 0.05 | 0.08 |

Table IV shows another preferred cleaner formulation in which the alkyl ester, EXXATE® 900 solvent, is used to replace part of an aromatic 200 type solvent. Cleaner 8 is similar to cleaner 7 except that it is a concentrate containing only 10 percent of added water. This concentrate can be used "as is" or it can be further diluted. The cleaners of Examples 7 or 8 had no flashpoint up to their boiling point.

These cleaners removed 92% of oil #6 based upon the Spray Tank Evaluation Test (STEP) and 98% of oil #6 based upon the Static Soak Evaluation Test (SSET) after 3 hours and 99.8% after 6 hours based upon an average of three evaluations.

EXAMPLE 9

(Removal of Baked-on Carbon Deposits)

This example illustrates the greatest challenge for the subject microemulsion cleaners. Baked-on carbon deposits are a particularly difficult class of deposits to clean and are found on various diesel and automotive parts, i.e. valves and valve stems, injectors, tips, nozzles, carburetors, etc.

Until now, the most effective products used to clean these parts contained cresylic acid and chlorinated solvents such as methylene chloride and chlorobenzene. Such solvents as well as cresylic acid, are now being banned by various regulatory agencies placing the ship or automotive engineer in a difficult predicament.

The microemulsion cleaners of the subject invention are more effective than any of these. They clean quickly, and easily remove such carbon deposits from carburetors, valves, nozzles and valve stems, injectors, etc. Another advantage of the microemulsion cleaners is that they can heated up to 60° C. for faster cleaning with light brushing to remove baked-on carbonized deposits since they do not have flashpoints. They are more powerful in this regard than any known "carbon removers" such as those containing cresylic acid, caustic, methylene chloride, etc. They are also far less toxic, and environmentally more desirable.

Our optimum microemulsion formulations for the "ready-to-use" cleaners and concentrates can be used to clean carbonized deposits and baked-on varnish deposits. Such deposits can be found in internal combustion engines, fuel lines, carburetor and multi-port fuel injectors.

Our optimum "ready-to-use" microemulsion cleaners and concentrates were evaluated for such cleaning applications against standard macroemulsion cleaners used in the automotive and/or marine industry such as:

VU-1065 (contains: cresylic acid, chromic acid, oxalic acid, potassium hydroxide, chlorinated hydrocarbon solvent, surfactant).

VU-1477 (contains: cresylic acid, potassium hydroxide surfactant and hydrocarbon solvent).

SNC 2000 (contains hydrocarbon solvent, terpene hydrocarbon and surfactant).

The microemulsion cleaner used was that disclosed in Example 7 of Table IV. Carburetor parts with heavy carbonized deposits were cleaned by soaking for 30 minutes. A panel of scientists judged cleaning performance of the various cleaners by giving numerical cleaning ratings (1 to 5) to these tests. A rating of 1="very poor" to "no cleaning" while a rating of 5=100% cleaning. The performance rating for the cleaners was:

| Cleaner | Rating |
|---|---|
| Uncleaned part | 1 |
| VU 1065 | 3 |
| SNC 2000 | 2 |
| Cleaner of Example 7, Table IV | 4 |

The results show that the microemulsion cleaner of Example 7 was more effective than the commercially available cleaners.

The cleaner of Example 7 was tested even further. The part cleaned with SNC 2000 (which cleaned poorly and had a "2" rating) was further cleaned with the cleaner of Example 7 for 30 minutes. After this additional cleaning, the rating was 4.

We claim:

1. A ready-to-use microemulsion cleaner comprising:
(a) an organic solvent in an amount of from 5 to 40 weight percent;
(b) a surfactant blend comprising an anionic surfactant and a nonionic surfactant in an amount of 5 to 40 weight percent wherein the weight ratio of anionic surfactant to nonionic surfactant in said surfactant blend is from 1:20 to 20:1;
(c) a glycol ether in an amount of 5 to 40 weight percent;
(d) morpholine in an amount of 5 to 40 weight percent; and
(e) water in an amount of 25 to 60 weight percent,
wherein said weight percent is based upon the total weight of the ready-to-use microemulsion cleaner and said cleaner does not have a flashpoint up to the boiling point of said cleaner.

2. The ready-to-use cleaner of claim 1 which also contains a defoamer in an amount of 0.001 to 0.5 weight percent, wherein said weight percent is based upon the weight of the ready-to-use microemulsion cleaner of claim 1.

3. The ready-to-use microemulsion cleaner of claim 2 wherein:
(a) an organic solvent is selected from the group consisting of dichlorotoluene, terpene hydrocarbon, oxyalcohol esters, m-pyrol, and mixtures thereof in an amount of from 7 to 18 weight percent;
(b) the surfactant blend comprises from about 10 to 25 weight percent of the microemulsion cleaner and comprises an anionic and nonionic surfactant wherein the weight ratio of anionic surfactant to nonionic surfactant is from 1:4 to 4:1;
(c) a glycol ether in an amount of from 18 to 22 weight percent;
(d) morpholine in an amount of 5 to 10 weight percent;
(e) the defoamer is a polysiloxane defoamer in an amount of from 0.001 to 0.1 weight percent; and
(f) water in an amount of from 45 to 55 weight percent,
said weight percent being based upon the total weight of the ready-to-use cleaner.

4. The ready-to-use microemulsion cleaner of claim 3 wherein said surfactant blend contains from 8 to 10 weight percent of nonionic surfactant and from 1.5 to 5 weight percent of anionic surfactant.

5. The ready-to-use microemulsion cleaner of claim 4 wherein the nonionic surfactant of said surfactant blend is a reaction product of linear alcohols with ethylene oxide having an average molecular weight of about 300 to about 3000 and the anionic surfactant is an alkyl sulfonate having an average molecular weight of about 300 to about 3000.

6. The ready-to-use microemulsion cleaner of claim 5 wherein the nonionic surfactant of the surfactant blend is a blend of ethoxylates of linear alcohols having $C_9$–$C_{11}$ carbon atoms in the chains of the linear alcohols, such that said linear alcohols are ethoxylated with an average of 2.5 and 6.0 moles of ethylene oxide per chain.

7. A microemulsion cleaner concentrate comprising:
(a) an organic solvent in an amount of from 10 to 40 weight percent;
(b) a surfactant blend comprising an anionic surfactant and a nonionic surfactant in an amount of 5 to 40 weight percent wherein the weight ratio of anionic surfactant to nonionic surfactant in said surfactant blend is from 1:20 to 20:1;
(c) a glycol ether in an amount of 15 to 40 weight percent;
(d) morpholine in an amount of at least 4 to 40 weight percent; and
(e) water in an amount of 3 to 25 weight percent,
wherein said weight percent is based upon the total weight of the ready-to-use microemulsion cleaner concentrate and said concentrate does not have a flashpoint up to the boiling point of said concentrate.

8. The microemulsion cleaner concentrate of claim 7 which also contains a defoamer in an amount of 0.001 to 0.5 weight percent, wherein said weight percent is based upon the weight of the microemulsion cleaner concentrate of claim 1.

9. The microemulsion cleaner concentrate of claim 8 wherein:
(a) an organic solvent is selected from the group consisting of dichlorotoluene, terpene hydrocarbon, oxyalcohol esters, m-pyrol, and mixtures thereof in an amount of from 18 to 25 weight percent;

(b) the surfactant blend comprises from about 15 to 25 weight percent of the microemulsion cleaner and comprises an anionic and nonionic surfactant wherein the weight ratio of anionic surfactant to nonionic surfactant is from 1:4 to 4:1;

(c) a glycol ether in an amount of from 30 to 35 weight percent;

(d) morpholine in an amount of 5 to 10 weight percent;

(e) the defoamer is a polysiloxane defoamer in an amount of from 0.001 to 0.1 weight percent; and (f) water in an amount of from 5 to 15 weight percent, said weight percent being based upon the total weight of the microemulsion cleaner concentrate.

10. The microemulsion cleaner concentrate of claim 9 wherein the surfactant blend contains from 8 to 10 weight percent of nonionic surfactant and from 3 to 5 weight percent of anionic surfactant.

11. The microemulsion cleaner concentrate of claim 10 wherein the nonionic surfactant of said surfactant blend is a reaction product of linear alcohols with several moles of ethylene oxide having an average molecular weight of about 300 to about 3000 and the anionic surfactant is an alkyl sulfonate having an average molecular weight of about 300 to about 3000.

12. The microemulsion cleaner concentrate of claim 11 wherein the nonionic surfactant of the surfactant blend is a blend of ethoxylates of linear alcohols having $C_9$–$C_{11}$ carbon atoms in the chains of the linear alcohols, such that said linear alcohols are ethoxylated with an average of 2.5 and 6.0 moles of ethylene oxide per chain.

13. A process for shampooing a metal engine which comprises applying a microemulsion cleaner to said engine wherein said microemulsion cleaner comprises:

(a) an organic solvent in an amount of from 5 to 40 weight percent;

(b) a surfactant blend comprising an anionic surfactant and a nonionic surfactant in an amount of 5 to 40 weight percent wherein the weight ratio of anionic surfactant to nonionic surfactant in said surfactant blend is from 1:20 to 20:1;

(c) a glycol ether in an amount of 5 to 40 weight percent;

(d) morpholine in an amount of 4 to 40 weight percent; and (e) water in an amount of 25 to 60 weight percent, wherein said weight percent is based upon the total weight of the ready-to-use microemulsion cleaner and said cleaner does not have a flashpoint up to the boiling point of said cleaner.

14. The process of claim 13 which comprises applying a microemulsion cleaner to said engine wherein said microemulsion cleaner comprises:

(a) an organic solvent selected from the group consisting of dichlorotoluene, terpene hydrocarbon, oxyalcohol esters, m-pyrol, and mixtures thereof in an amount of from 7 to 18 weight percent;

(b) the surfactant blend comprises from about 10 to 25 weight percent of the microemulsion cleaner and comprises an anionic and nonionic surfactant wherein the weight ratio of anionic surfactant to nonionic surfactant is from 1:4 to 4:1;

(c) a glycol ether in an amount of from 18 to 22 weight percent;

(d) morpholine in an amount of 5 to 10 weight percent; and (e) water in an amount of from 45 to 55 weight percent, said weight percent being based upon the total weight of the ready-to-use cleaner.

15. The process of claim 14 wherein said surfactant blend contains from 8 to 10 weight percent of nonionic surfactant and from 1.5 to 5 weight percent of anionic surfactant.

16. The process of claim 15 wherein the nonionic surfactant of said surfactant blend is a reaction product of linear alcohols with several moles of ethylene oxide having an average molecular weight of about 300 to about 3000 and the anionic surfactant is an alkyl sulfonate having an average molecular weight of about 300 to about 3000.

17. The process of claim 16 wherein the nonionic surfactant of said surfactant blend is a blend of ethoxylates of linear alcohols having $C_9$–$C_{11}$ carbon atoms in the chains of the linear alcohols, such that said linear alcohols are ethoxylated with an average of 2.5 and 6.0 moles of ethylene oxide per chain.

18. A process for shampooing a metal engine which comprises applying a microemulsion cleaner concentrate to said engine wherein said microemulsion cleaner concentrate comprises:

(a) an organic solvent in an amount of from 10 to 40 weight percent;

(b) a surfactant blend comprising an anionic surfactant and a nonionic surfactant in an amount of 5 to 40 weight percent wherein the weight ratio of anionic surfactant to nonionic surfactant in said surfactant blend is from 1:20 to 20:1;

(c) a glycol ether in an amount of 15 to 40 weight percent;

(d) morpholine in an amount of at least 4 to 40 weight percent;

(e) a defoamer in the amount of 0.001 to 0.1 weight percent, and (f) water in an amount of 3 to 25 weight percent, wherein said weight percent is based upon the total weight of the ready-to-use microemulsion cleaner concentrate add said concentrate does not have a flashpoint up to the boiling point of said concentrate.

19. The process of claim 18 wherein the microemulsion cleaner concentrate to said engine wherein said microemulsion cleaner concentrate comprises:

(a) an organic solvent is selected from the group consisting of dichlorotoluene, terpene hydrocarbon, oxyalcohol esters, m-pyrol, and mixtures thereof in an amount of from 18 to 25 weight percent;

(b) the surfactant blend comprises from about 15 to 25 weight percent of the microemulsion cleaner and comprises an anionic and nonionic surfactant wherein the weight ratio of anionic surfactant to nonionic surfactant is from 1:4 to 4:1;

(c) a glycol ether in an amount of from 30 to 35 weight percent;

(d) morpholine in an amount of 5 to 10 weight percent;

(e) the defoamer is a polysiloxane defoamer in an amount of from 0.001 to 0.1 weight percent; and (f) water in an amount of from 5 to 15 weight percent, said weight percent being based upon the total weight of the microemulsion cleaner concentrate.

20. The process of claim 19 wherein the microemulsion cleaner concentrate to said engine wherein said microemulsion cleaner concentrate comprises:

(a) an organic solvent is selected from the group consisting of dichlorotoluene, terpene hydrocarbon, oxyalcohol esters, m-pyrol, and mixtures thereof in an amount of from 7 to 18 weight percent;

(b) the surfactant blend comprises from about 10 to 25 weight percent of the microemulsion cleaner and comprises an anionic and nonionic surfactant wherein the weight ratio of anionic surfactant to nonionic surfactant is from 1:4 to 4:1;

(c) a glycol ether in an amount of from 18 to 22 weight percent;

(d) morpholine in an amount of 5 to 10 weight percent;

(e) the defoamer is a polysiloxane defoamer in an amount of from 0.001 to 0.1 weight percent; and (f) water in an amount of from 5 to 15 weight percent weight, said weight percent being based upon the total weight of the microemulsion cleaner concentrate.

21. The process of claim 20 wherein the microemulsion cleaner concentrate to said engine wherein said microemulsion cleaner concentrate wherein the surfactant blend contains from 8 to 10 weight percent of nonionic surfactant and from 1.5 to 5 weight percent of anionic surfactant.

22. The process of claim 21 wherein the microemulsion cleaner concentrate to said engine wherein said microemulsion cleaner concentrate wherein the nonionic surfactant of said surfactant blend is a reaction product of linear alcohols with several moles of ethylene oxide having an average molecular weight of about 300 to about 3000 and the anionic surfactant is an alkyl sulfonate having an average molecular weight of about 300 to about 3000.

23. The process of claim 22 wherein the microemulsion cleaner concentrate to said engine wherein said microemulsion cleaner concentrate wherein the nonionic surfactant of the surfactant blend is a blend of ethoxylates of linear alcohols having $C_9$–$C_{11}$ carbon atoms in the chains of the linear alcohols, such that said linear alcohols are ethoxylated with an average of 2.5 and 6.0 moles of ethylene oxide per chain.

* * * * *